US005156525A

United States Patent [19]

Ciokajlo

[11] Patent Number: 5,156,525

[45] Date of Patent: Oct. 20, 1992

[54] TURBINE ASSEMBLY

[75] Inventor: John J. Ciokajlo, Cincinnati, Ohio

[73] Assignee: General Electric Company, Cincinnati, Ohio

[21] Appl. No.: 660,484

[22] Filed: Feb. 26, 1991

[51] Int. Cl.[5] ..... F01D 1/26

[52] U.S. Cl. ..... 415/199.5; 415/190; 416/201 R; 416/220 R

[58] Field of Search ..... 415/198.1, 199.5, 190; 416/201 R, 219 R, 220 R

[56] References Cited

U.S. PATENT DOCUMENTS

| | | | |
|---|---|---|---|
| 3,094,309 | 6/1963 | Hull, Jr. et al. | 416/201 R |
| 3,249,293 | 5/1966 | Koff . | |
| 3,692,429 | 9/1972 | Redding | 416/201 |
| 3,706,509 | 12/1972 | Britt | 415/131 |
| 3,807,895 | 4/1974 | McMurtry | 415/199 R |
| 4,016,636 | 4/1977 | Schneider et al. | 29/156.8 R |
| 4,277,225 | 7/1981 | Dubois et al. | 416/198 A |
| 4,483,054 | 11/1984 | Ledwith | 29/156.8 R |
| 4,526,508 | 7/1985 | Antonellis et al. | 415/172 A |
| 4,809,498 | 3/1989 | Giffin, III et al. | 416/129 |
| 4,844,694 | 7/1989 | Naudet | 416/198 A |

OTHER PUBLICATIONS

General Electric Company, Two sheets showing cross--sections of GE CF6-80C2 engine, one captioned "CF6-80C2 Engine Airflow FADEC Control," and one uncaptioned. CF6-80C2 engine in public use more than one year prior to filing date of subject application.

*Primary Examiner*—Edward K. Look
*Assistant Examiner*—Michael S. Lee
*Attorney, Agent, or Firm*—Jerome C. Squillaro

[57] ABSTRACT

A turbine assembly includes a unitary rotor spool having first and second rotor discs. A set of first blades having axial entry dovetails are joined to the first disc, and a set of second blades having axial entry dovetails are joined to the second disc. A unitary annular spacer is disposed axially between the first and second dovetails for preventing the first and second blades from sliding axially toward the spacer. The spacer has an inner diameter greater than an outer diameter of the first rotor disc for allowing the spacer to be assembled over the first rotor disc during assembly.

20 Claims, 6 Drawing Sheets

TURBINE ASSEMBLY

TECHNICAL FIELD

The present invention relates generally to gas turbine engines, and, more specifically, to a power turbine therein.

BACKGROUND ART

In a conventional turbofan gas turbine engine a fan, compressor, high pressure turbine (HPT), and low pressure turbine (LPT) are disposed in serial flow communication. The HPT extracts energy from combustion gases flowing therethrough to power the compressor, and the LPT further extracts energy from the combustion gases for powering the fan. A conventional LPT includes a plurality of axial stages of stator vanes extending radially inwardly from a casing and rotor blades extending radially outwardly from rotor discs. The casing is typically split along a horizontal centerline plane for forming two 180° half casings which allow for relatively simple manufacture of the component parts and assembly thereof over the rotor blades and discs. However, this arrangement results in two horizontal flanges spaced 180° apart on each of the half casings, respective ones of which are bolted together during assembly of the LPT. The horizontal flanges, therefore, result in a non-uniform stator casing which during operation of the LPT result in generally elliptical distortion of the casing due to differential temperatures in the casing and pressure loads therein. Since conventional shrouds are attached to the casing and spaced relatively close to the blade tips, any circumferential distortion of the casing affects the shroud-to-blade tip clearance, and therefore, affects LPT performance. As blade tip clearance increases, performance of the LPT decreases.

Also in a conventional LPT, the turbine rotor is formed from several independent rotor discs which include flanges for being bolted together in the LPT. In this way, the conventional dovetail slots in the disc perimeters, either circumferentially extending or axially extending, may be formed independently for each disc and prior to assembly of the several discs. However, manufacturing tolerances of the several rotor discs necessarily require rotor balancing of the entire rotor assembly. Furthermore, the rotor discs are typically bolted together, and during operation of the LPT, relative movement between adjacent rotor discs due to potential slippage at the bolts may result in a degree of unbalance of the rotor during operation which may lead to engine vibration.

OBJECTS OF THE INVENTION

Accordingly, one object of the present invention is to provide a new and improved turbine assembly having relatively few discrete components which is simpler to manufacture and assemble.

Another object of the present invention is to provide a turbine which eliminates the casing horizontal split flanges.

Another object of the present invention is to provide a turbine assembly having a rotor which eliminates bolted discs, or reduces the number of bolted connections for saving weight, reducing manufacturing costs, improving rotor reliability, and reducing the amount of balance correction required.

DISCLOSURE OF INVENTION a turbine assembly includes a unitary rotor spool having first and second rotor discs. A plurality of first blades having axial entry dovetails are joined to the first disc, and a plurality of second blades having axial entry dovetails are joined to the second disc. A unitary annular spacer is disposed axially between the first and second dovetails for preventing the first and second blades from sliding axially toward the spacer. The spacer has an inner diameter greater than an outer diameter of the first rotor disc for allowing the spacer to be assembled over the first rotor disc during assembly.

BRIEF DESCRIPTION OF DRAWINGS

The novel features believed characteristic of the invention are set forth and differentiated in the claims. The invention, in accordance with a preferred and exemplary embodiment, together with further objects and advantages thereof, is more particularly described in the following detailed description taken in conjunction with the accompanying drawing in which:

MODE(S) FOR CARRYING OUT THE INVENTION

Figure 1:
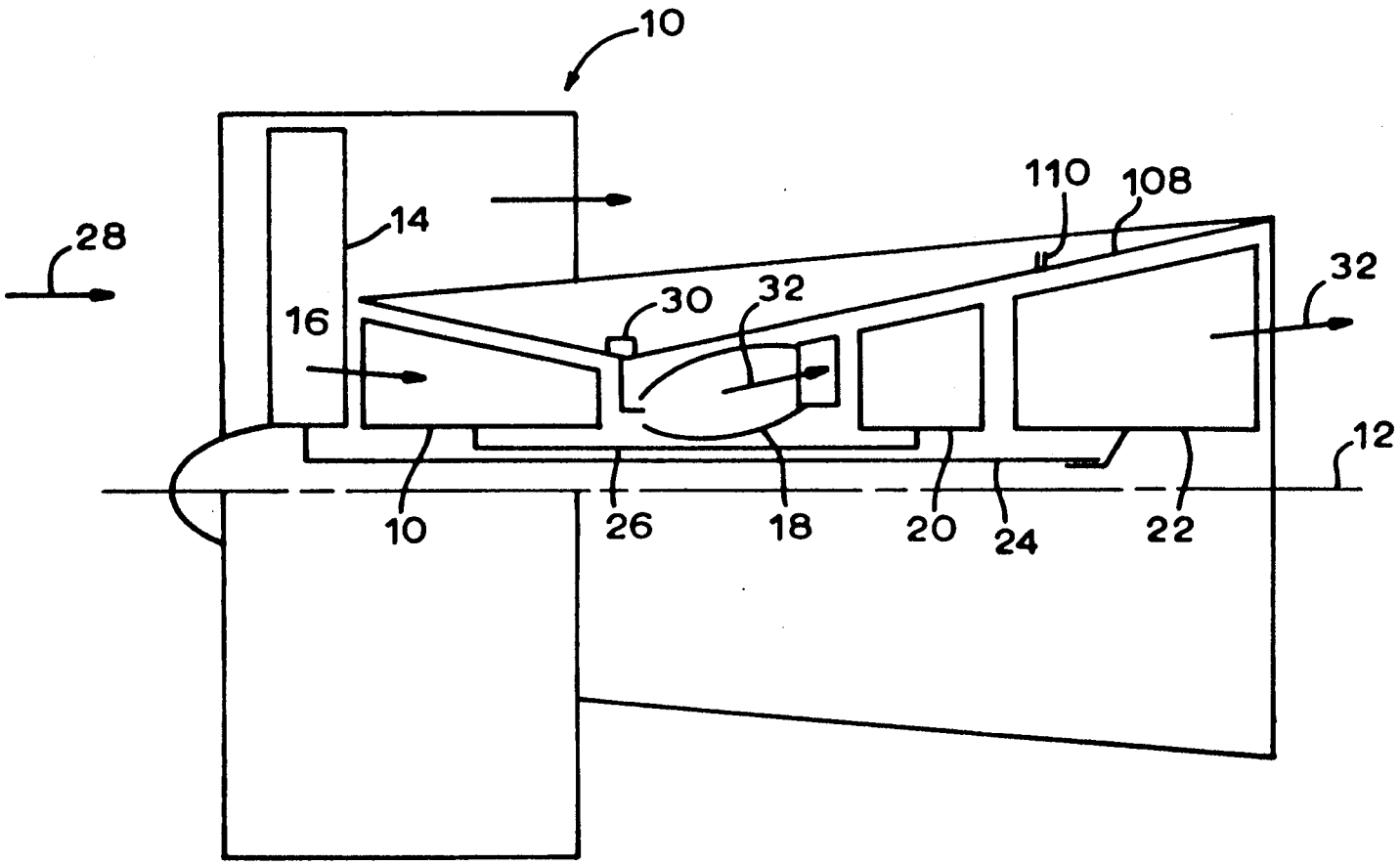
FIG. 1 is a longitudinal, sectional, schematic view of an exemplary turbofan engine having a turbine assembly in accordance with one embodiment of the present invention.

Illustrated in FIG. 1 is an exemplary turbofan gas turbine engine 10 having a longitudinal axial centerline axis 12. The engine 10 includes in serial flow communication a conventional fan 14, a conventional compressor 16, a conventional annular combustor 18, a conventional high pressure turbine (HPT) 20, and a low pressure turbine (LPT) 22 in accordance with one embodiment of the present invention. The LPT 22 is conventionally fixedly joined through a low pressure (LP) shaft 24 to the fan 14, and the HPT 20 is conventionally joined to the compressor 16 through a high pressure (HP) shaft 26.

During operation of the engine 10, ambient air 28 is channeled through the rotating fan 14, an outer portion of which provides thrust and an inner portion of which is channeled into the compressor 16 wherein it is compressed and discharged into the combustor 18. A conventional fuel supply means 30 introduces fuel to the compressed air in the combustor 18, which is conventionally ignited for generating combustion gases 32. The combustion gases 32 are channeled downstream through the HPT 20 which extracts energy therefrom for powering the compressor 16, and the LPT 22 also extracts energy from the combustion gases 32 for powering the fan 14.

Figure 2:
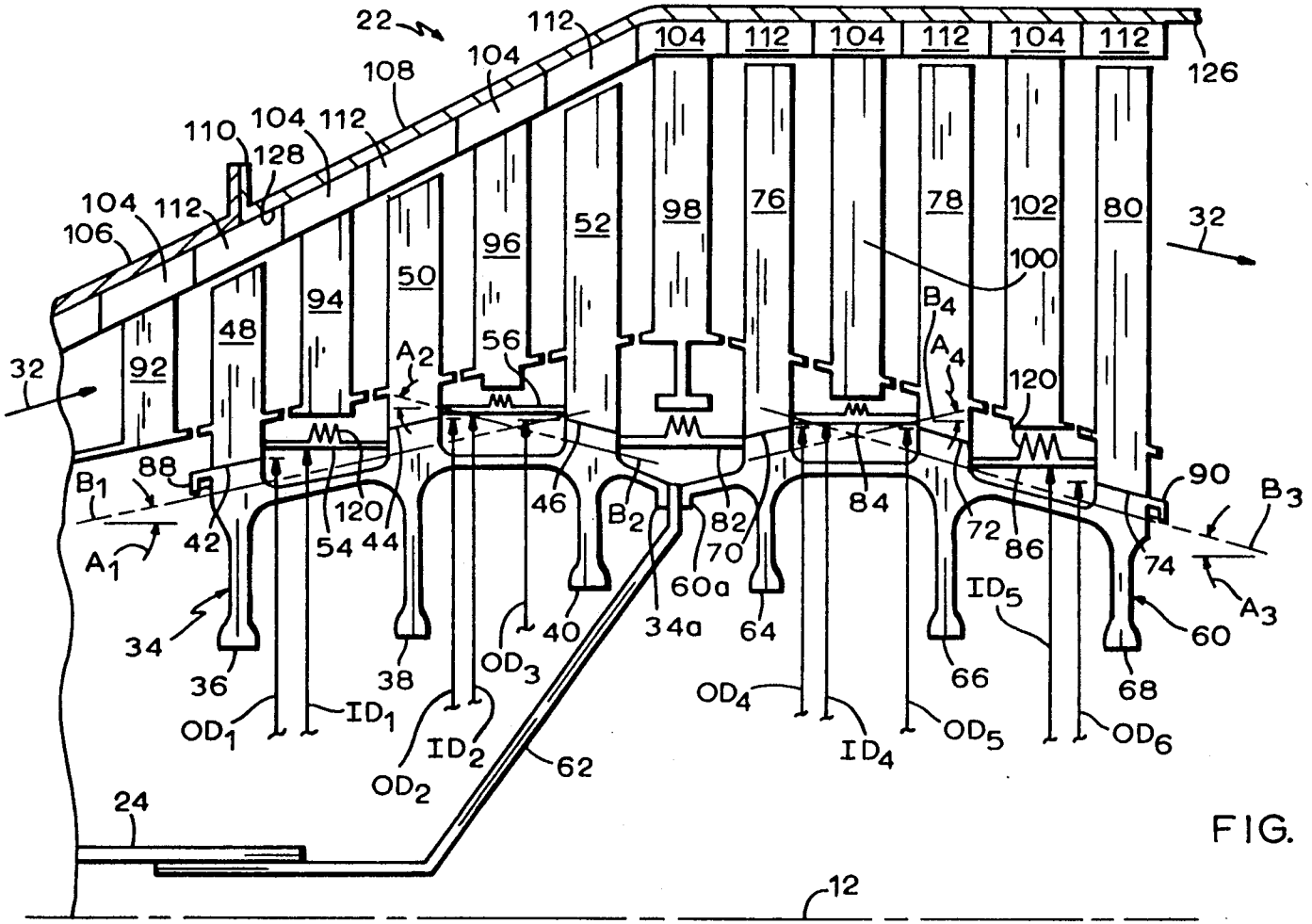
FIG. 2 is an enlarged, longitudinal sectional schematic view of the turbine assembly illustrated in FIG. 1 in accordance with one embodiment of the present invention.

The LPT 22 in accordance with one embodiment of the present invention is illustrated in more particularity in FIG. 2. The LPT 22, or turbine assembly, includes a unitary forward, or first, rotor spool 34 which includes integral, axially spaced apart first, second, and third rotor discs 36, 38 and 40, respectively. The discs 36, 38, and 40 include respective first, second, and third perimeters 42, 44, 46, having first, second, and third outer diameters $OD_1$, $OD_2$, and $OD_3$. respective pluralities of circumferentially spaced conventional first, second, and third rotor blades 48, 50, and 52, are conventionally joined to the perimeters 42, 44, and 46.

Figure 3:
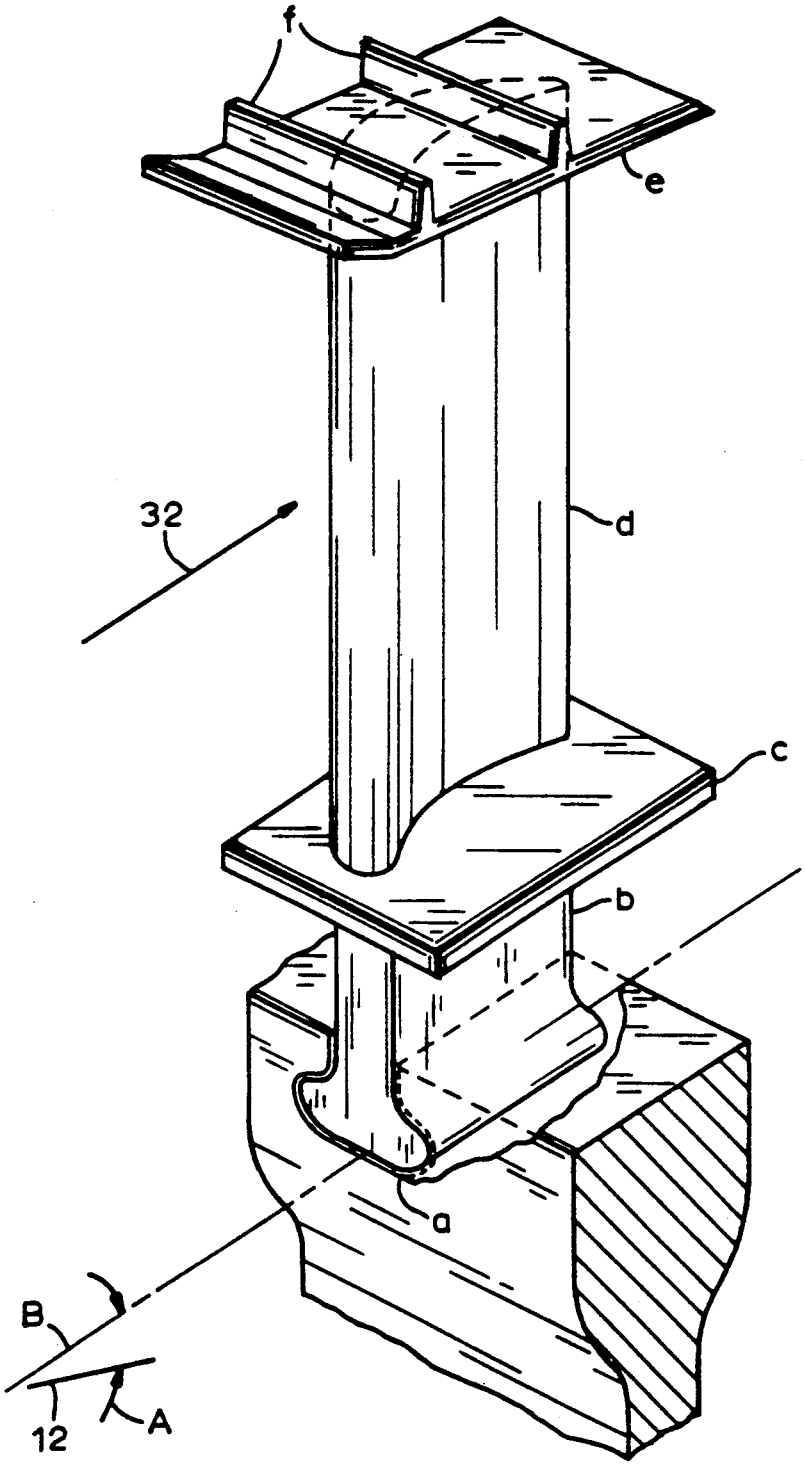
FIG. 3 is a perspective view of an exemplary rotor blade and a portion of a turbine disc of the turbine assembly illustrated in FIG. 2.

Illustrated in FIG. 3 is a rotor blade and rotor disc assembly representative of all the blades and discs of the LPT 22. Each of the rotor discs of the LPT 22 includes a plurality of circumferentially spaced, axially extending dovetail sots (a) formed in the rotor disc perimeter. Each of the rotor blades includes a conventional dovetail (b) which is complementary in shape to the dovetail slot (a) for being radially retained therein. Each of the blades also includes a blade platform (c) for defining an inner flow boundary for the combustion gases 32 which flow over an airfoil (d) of the blade. Each blade may also include a conventional, integral tip shroud (e) which defines an outer boundary for the combustion gases 32. Each of the tip shrouds (e) may include a pair of axially spaced, radially extending conventional tip seal teeth (f) which form a seal with a conventional stator shroud (not shown in FIG. 3) as described below.

In the exemplary embodiment of the present invention, the dovetail slots (a) are conventionally formed by broaching wherein a series of linearly aligned broaches are sequentially passed along and through the disc perimeter for forming the dovetail slots (a). The base of the finally formed dovetail slot (a) and its axial orientation is defined herein by a broach line B which is disposed at an acute broach angle A relative to the longitudinal centerline axis of the disc which is also the longitudinal centerline axis 12 of the engine 10 and the LPT 22.

The lower case letter designations of the various components illustrated in FIG. 3 will be used herein as a suffix to the numeral designation of the corresponding components in the several stages of the LPT 22. For example, the dovetail of the first rotor blade 48 illustrated in FIG. 2 is designated as the first dovetail **48*b*, which is disposed in its complementary first dovetail slot 36*a* of the first rotor disc 36. Accordingly, the component designations illustrated in FIG. 3** shall be used with the other Figures of the drawing for indicating respective components.

Referring again toe FIG. 2, the LPT 22 further includes in accordance with one embodiment of the present invention a unitary, annular first spacer 54 disposed axially between the first and second dovetails **48*b* and 50*b* for preventing the first and second blades 48 and 50 from sliding axially from their respective discs 36 and 38 toward the first spacer 54. The first spacer 54 has a predetermined axial length to abut both the first and second dovetails 48*b* and 50*b* for retaining the blades 48 and 50 in the first and second dovetail slots 36*a* and 38*a***.

Figure 4:
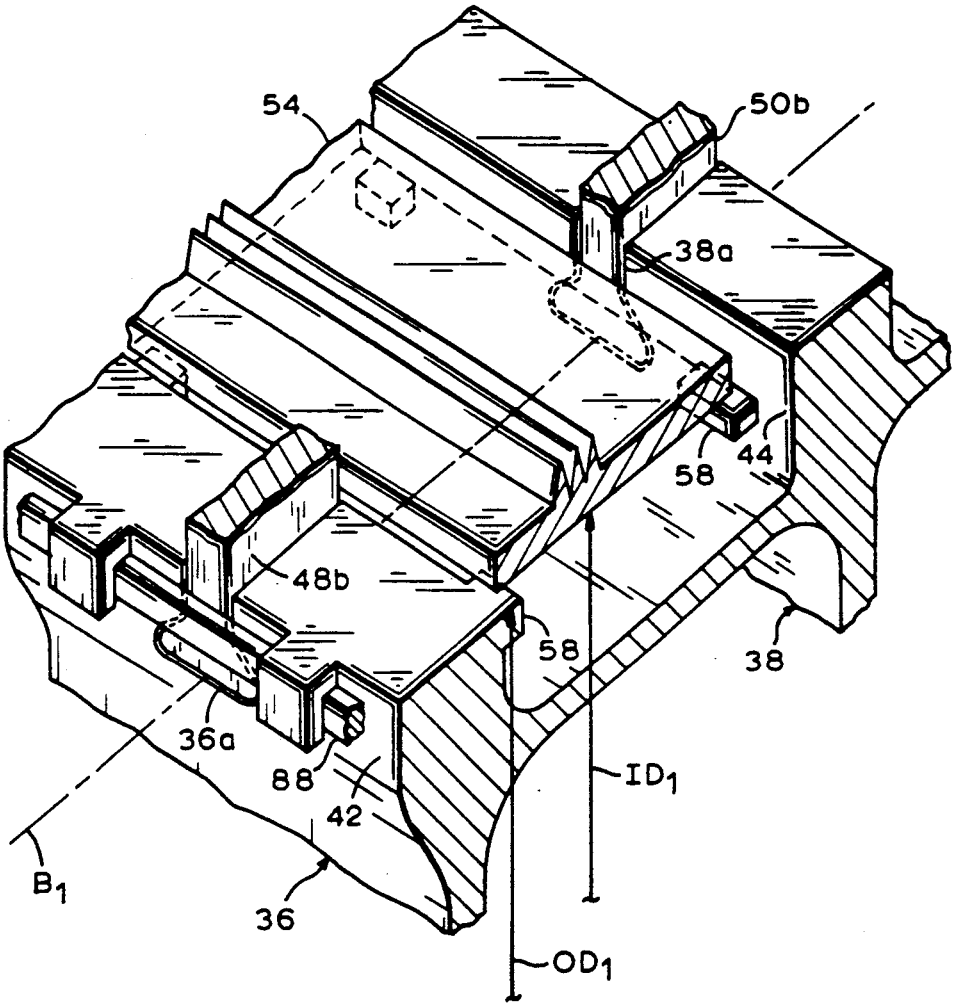
FIG. 4 is a perspective view of an exemplary first spacer positioned between the first and second rotor discs illustrated i FIG. 2.

FIG. 4 illustrates in more particularity the first spacer 54 assembled between the first and second discs 36 and 38. Referring also to FIG. 2, the first spacer 54 is preferably cylindrical and has an inner diameter $ID_1$ which is preferably greater than the outer diameter $OD_1$ of the first disc 36 for allowing the first spacer 54 to be assembled over the first disc 36 during assembly as described in more detail below. A unitary, annular, cylindrical second spacer 56 is similarly axially disposed between the second and third rotor discs 38 and 40 for abutting the second and third dovetails **50*b* and 50*b* for axially retaining the second and third blades 50 and 52**.

As illustrated in FIG. 4, a plurality of circumferentially spaced conventional rabbets 58 extend axially from at least one of, and in this case both of the first and second discs 36 and 38 at the perimeters 42 and 44 for radially supporting the first spacer 54. Similar rabbets 58 preferably also radially support the second spacer 56.

As illustrated in FIG. 2, the second spacer 56 has an inner diameter $ID_2$ which is preferably greater than the outer diameter $OD_3$ of the third disc 40 for allowing the second spacer 56 to be assembled over the third disc 40 during assembly as described below. Also as described below with respect to the assembly of the LPT 22, the LPT 22 preferably includes both the first rotor spool 34 and a second, or aft, rotor spool 60, both spools including respective flanges **34*a* and 60*a* which are conventionally joined to a conventional cone 62 which is conventionally joined to the LP shaft 24**, by a spline for example.

The second spool 60 includes fourth, fifth, and sixth rotor discs 64, 66, and 68, respectively having respective fourth, fifth, and sixth perimeters 70, 72, and 74 with respective fourth, fifth, and sixth outer diameters $OD_4$, $OD_5$, and $OD_6$. Respective pluralities of conventional fourth, fifth, and sixth rotor blades 76, 78, and 80 are conventionally joined to the discs 64, 66, and 68, as represented in FIG. 3. More specifically, respective pluralities of circumferentially spaced, axially extending fourth, fifth, and sixth dovetail slots **64*a*, 66*a*, and 68*a* are provided in the discs which receive respective ones of the fourth, fifth, and sixth blade dovetails 76*b*, 78*b*, and 80*b*** respectively.

A unitary, annular, cylindrical third spacer 82 is disposed axially between the third disc 40 and the fourth disc 64 and abuts against the third dovetails **52*b* and the fourth dovetails 76*b* for preventing the third and fourth blades 52 and 76 from sliding axially toward the third spacer 82**.

A unitary, annular, cylindrical fourth spacer 84 is disposed axially between the fourth disc 64 and the fifth disc 66 and abuts against the fourth dovetails **76*b* and the fifth dovetails 78*b* for preventing the fourth and fifth blade 76 and 78 from sliding axially toward the fourth spacer 84**.

Similarly, a unitary, annular, cylindrical fifth spacer 86 is disposed axially between the fifth disc 66 and the sixth disc 68 and abuts against the fifth dovetails **78*b* and the sixth dovetails 80*b* for preventing the fifth and sixth blades 78 and 80 from sliding axially toward the fifth spacer 86. All of the spacers 54, 56, 82, 84, and 86 are similar in abutting against adjacent dovetails for axially retaining the respective blades in their respective dovetail slots (a). A conventional forward blade retainer 88, as shown in FIGS. 2 and 4 in the form of a snap ring, is provided for preventing the first blades 48 from moving in a axially upstream direction. A conventional aft blade retainer 90, as shown in FIG. 2 and which is also in the form of the snap ring (88) shown in FIG. 4, is provided on the sixth disc 68 for preventing the sixth blade 80 from moving in an aft direction. In this way, all of the blades of the LPT 22** are axially retained from movement during operation.

The second, fourth, and fifth spacers 56, 84, and 86 are also readily positioned on rabbets 58, such as those shown in FIG. 4, which rabbets 58 are provided on at least one of the discs adjacent to the respective spacers. The third spacer 82, however, includes a radially inwardly extending flange (not shown) which is conventionally fixedly joined to, or sandwiched with, the cone 62 and the flanges 34*a* and 60*a*.

As illustrated in FIG. 2, the fifth spacer 86 has an inner diameter $ID_5$ which is preferably greater than the outer diameter $OD_6$ of the sixth disc 68 for allowing the fifth spacer 86 to be assembled over the sixth disc 68. Similarly, the fourth spacer 84 has an inner diameter $ID_4$ which is preferably greater than at least one of the outer diameters $OD_4$ and $OD_5$ of the fourth disc 64 and the fifth disc 66 for allowing the fourth spacer 84 to be assembled over respective ones thereof. In the preferred embodiment of the present invention, the inner diameter $ID_4$ is greater than both the outer diameter $OD_5$ and $OD_6$ so that the fourth spacer 84 may be assembled over both the fifth disc 66 and the sixth disc 68.

As also illustrated in FIG. 2, the LPT 22 includes respective pluralities of conventional stator vanes i.e., first, second, third, fourth, fifth, and sixth stator vanes 92, 94, 96, 100, and 102 disposed axially upstream of respective blades 48, 50, 52, 76, 78, and 80. The stator vanes are conventionally removable, either individually or in arcuate segments of several vanes. This is accomplished by providing conventional hooked supports designated schematically as supports 104. In order to allow the LPT 22 to be a modular assembly, it includes a forward annular casing 106 conventionally fixedly joined to an aft annular casing 108 at a conventional vertical, or radial, flange 110. In the preferred embodiment of the present invention all of the vane supports 104, except for the first vanes 92, are removably joined to the aft casing 108, with the support 104 of the first vanes 92 being removably joined to the forward casing 106. Also in accordance with the preferred embodiment, the aft casing 108 is a unitary, 360° annular casing characterized by not having any horizontal split flanges which would allow the disassembly of the aft casing 108 itself. Disposed between adjacent vane supports 104 are conventional shrouds 112 which are conventionally interlocked with the vane support 104 and spaced radially outwardly of respective blade tip shrouds (e) for forming seals with the blade tip seal teeth (f).

Figure 5:
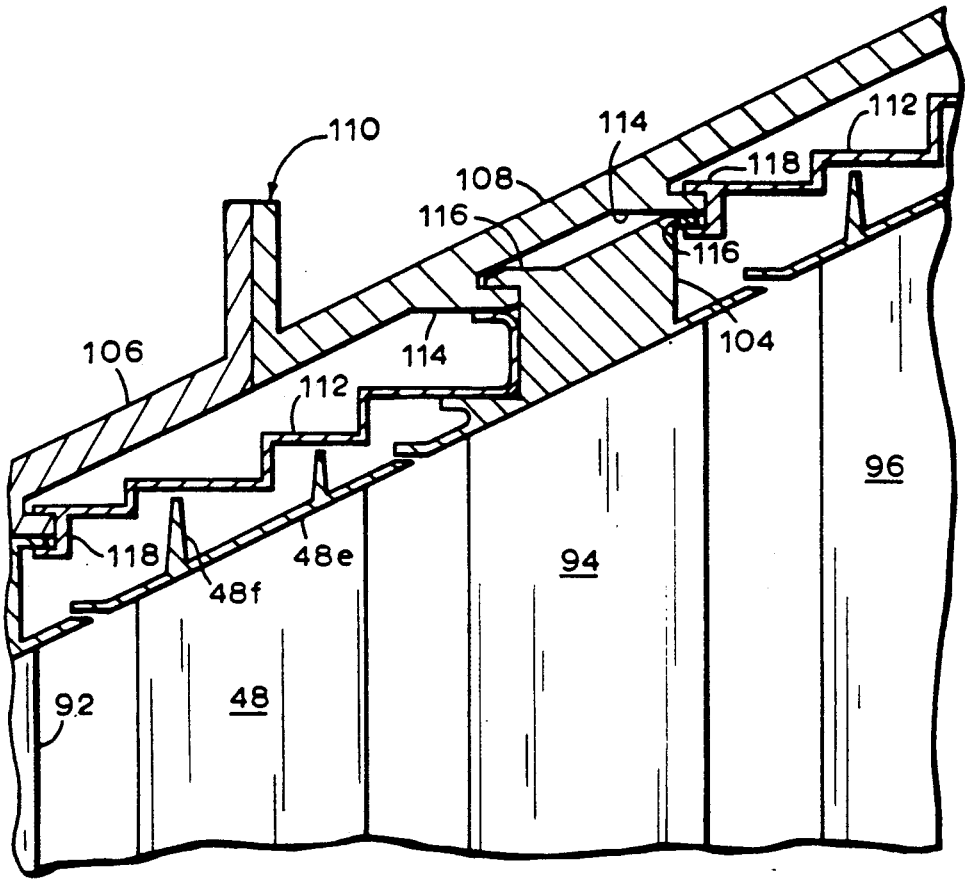
FIG. 5 is an enlarged, longitudinal, sectional schematic view of several rotor blades and stator vanes joined to the casing as illustrated schematically in FIG. 2.

More specifically, FIG. 5 illustrates exemplary ones of the vane supports 104 and the shrouds 112 joined to the casings 106 and 108. The casings include conventional fingers 114 against which hooks 116 of the vane supports 104 are positioned. The shrouds 112 include U-shaped recesses 118 at one end which are positioned over respective fingers 114 and hooks 116 for holding the support 104 to the casing. An opposite end of the shroud 112 is U-shaped and is positioned between the support 104 and a respective finger 114 for attaching her shroud 112 to the casing. Other conventional vane supports 104 and shrouds 112 could also be used for allowing assembly and disassembly thereof.

As illustrated in FIG. 2, each of the spacers 54, 56, 82, 84, and 86 includes a plurality of radially outwardly extending labyrinth seal teeth 120 for forming a seal with respective ones of the stator vanes having portions disposed radially outwardly therefrom and closely adjacent thereto.

Figure 6:
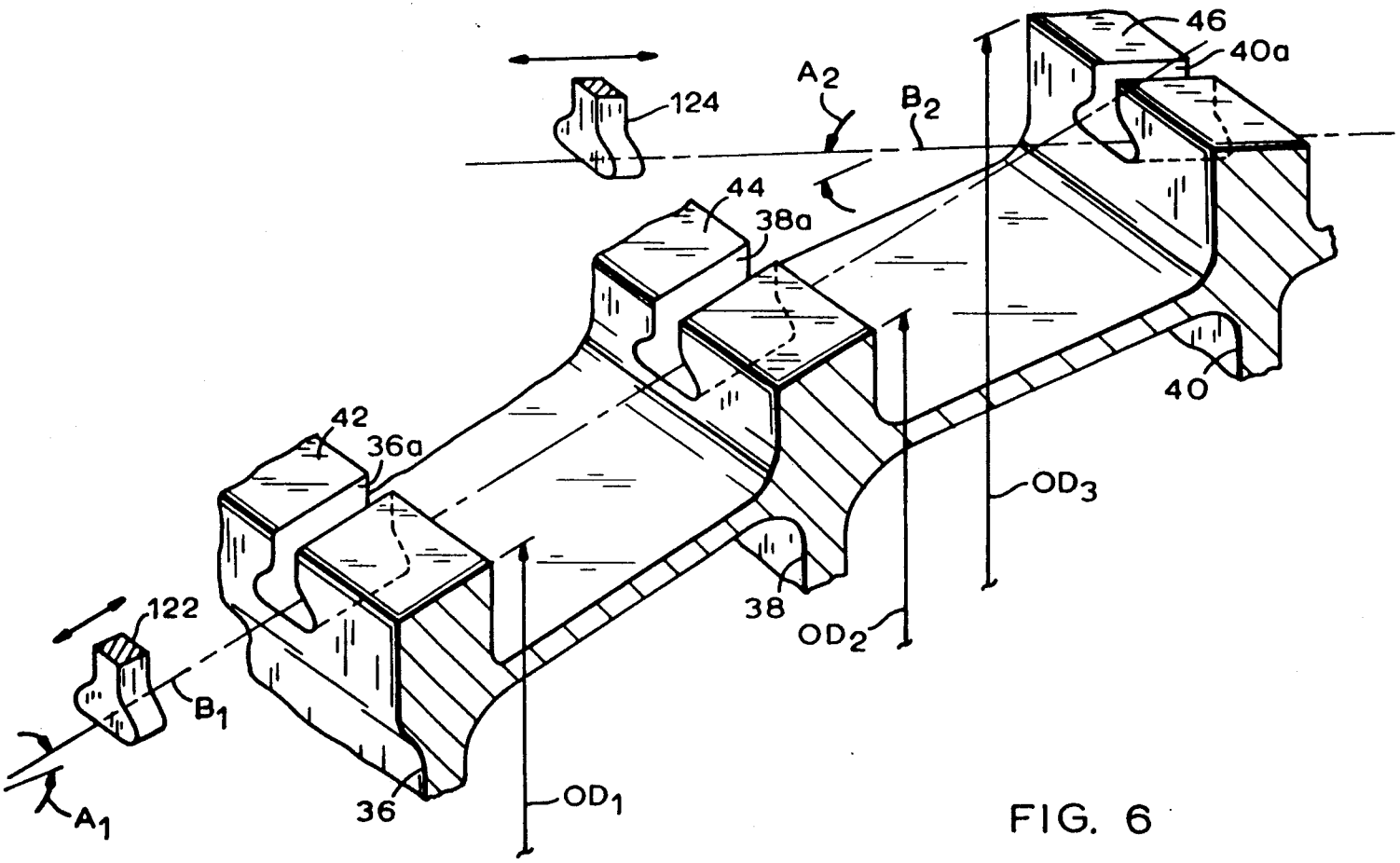
FIG. 6 is a perspective, partly schematic view of a portion of the forward rotor spool illustrated in FIG. 2 showing respective dovetail slots in the rotor discs thereof with respective lines of broaching operation thereof.

In accordance with another feature of the present invention, the first and second discs 36 and 38 include an equal number of first and second dovetail slots 36*a* and 38*a*, for example 154 each, with respective ones thereof being axially aligned with each other for allowing the respective slot to be formed in a single path conventional broaching operation. FIG. 6 illustrates schematically the broaching operation for forming the respective dovetail slots. The first and second dovetail slots 36*a* and 38*a* are preferably axially aligned along a first broach line $B_1$, which is also illustrated in FIG. 2, and the first broach line $B_1$ is preferably radially inclined at an acute first broach angle $a_1$ relative to the longitudinal centerline axis 12 of the first rotor spool 34 with the second outer diameter $OD_2$ being larger than the first outer diameter $OD_1$ for allowing the first spacer 54 to be axially positioned over the first perimeter 42 and between the first and second discs 36 and 38 during assembly.

Also in the preferred embodiment of the present invention the third dovetail slots 40*a* are each axially aligned along a second broach line $B_2$ radially inclined at an acute second broach angle $A_2$ relative to the longitudinal axis 12. The first and second broach angles $A_1$ and $A_2$ are preedeterminedly selected so that the first broach line $B_1$ extends radially over the third perimeter 46, as illustrated in FIGS. 2 and 6, and the second broach line $B_2$ extends radially over both the first and second perimeters 42 and 44. As shown in FIG. 6, the conventional broaching tool, which is a series of linearly spaced, increasing dimensioned broaching tools represented schematically by a single first broach tool 122, is provided for movement along the first broach line $B_1$ for forming both the first and second dovetail slots 36*a* and 38*a*. Since during conventional broaching operation, the first tool 122 passes linearly along the first broach line $B_1$, the orientation of the first broach line $B_1$ is selected so that the first broach tool 122 misses or clears the third perimeter 46, the therefore does not cut the third disc 40. Similarly, the orientation of the second broach line $B_2$ is selected so that the movement of a conventional second broach tool 124, also shown schematically, along the second breach line $B_2$ passes over both the first and second perimeters 42 and 44 so that those perimeters are not cut in the broaching operation of the third disc 40.

The aft rotor spool 60 is similarly broached. In the aft rotor spool 60, an equal number of the fifth and sixth dovetail slots 66*a* and 68*a* are preferred with respective ones thereof being axially aligned along a third broach line $B_3$, as shown in FIG. 2, radially inclined at an acute third broach angle $A_3$ relative to the centerline axis 12 with the fifth outer diameter $OD_5$ being larger than the sixth outer diameter $OD_6$ for allowing the fifth spacer 86 to be axially positioned over the sixth perimeter 74 and between the fifth and sixth discs 66 and 68 during assembly. The broaching operation along the third broach line $B_3$ is similar to the broaching operation along the first broach line $B_1$ as illustrated in FIG. 6, and in this exemplary embodiment of the present invention there are 122 each of the fifth and sixth dovetail slots 66*a* and 68*a*.

The fourth dovetail slots 64*a* are each preferably axially aligned along a fourth broach line $B_4$, as shown in FIG. 2, radially inclined at an acute fourth broach angle $A_4$ relative to the centerline axis 12. The third and fourth broach angles $A_3$ and $A_4$ are preselected so that the third broach line $B_3$ extends radially over the fourth perimeter 70, and the fourth broach line $B_4$ extends radially over both the fifth and sixth perimeters 72 and 74. The broaching operation along the fourth broach line $B_4$ is similar to the broaching operation along the second broach line $B_2$ illustrated in FIG. 6. In the preferred embodiment of the present invention, the same broach tool. i.e., the second broach tool 124 may be used for broaching both the third dovetail slots 40*a* and the fourth dovetail slots 64*a* for reducing the number of required broaching tools from six, one each for the respective discs, to three, i.e., the common first broach tool 122 for the first and second discs 36 and 38, the second broach tool 124 for the third and fourth discs 40 and 64, and a third common broach tool for the fifth and sixth discs 66 and 68. As described above, the first broach tool 122 is predeterminedly sized for creating 154 dovetail slots around the circumference of each of the first and second discs 36 and 38, and the third broach tool is sized for forming 122 dovetail slots in each of the fifth and sixth discs 66 and 68. And, the second broach tool 124 is sized for forming 170 dovetail slots in each of the third and fourth discs 40 and 64 in this exemplary embodiment. In an exemplary and preferred embodiment of the present invention, the first broach angle $A_1$ may be equal to the third broach angel $A_3$, and the second broach angle $A_2$ may be equal to the fourth broach angle $A_4$ for simplifying the manufacturing of the respective rotor discs.

Referring to FIG. 2, a preferred method of assembling the LPT 22 may be described. Since the aft casing 108 is a unitary annular member without horizontal split flanges, then the resulting LPT 22 will not be subject to the circumferentially varying blade tip clearances found in a conventional casing having horizontal split flanges. However, since the aft casing 108 is not horizontally split, a new method of assembly of the component parts of the LPT 22 is required.

Firstly, the method includes positioning the first rotor spool 34 inside the empty aft casing 108 and then assembling the second vanes 94 to the casing from an aft end 126 of the aft casing 108. The second vanes 94, as well as the subsequent vanes, are conventionally joined to the aft casing 108 at the fingers 114 by the supports 104 as shown in FIG. 5.

The method then includes positioning the first spacer 54 from a forward end 128 of the aft casing 108 over the first disc 36 and between the first and second discs 36 and 38. The first blades 48 are then assembled in the first disc 36 from the casing forward end 128 with the respective dovetails 48*b* being axially positioned in the first dovetail slots 36*a*. The forward retaining ring 88 is then assembled to the first disc 36 for preventing the first blades 48 from sliding axially forwardly. The shrouds 112 are then assembled over the first blades 48 to the aft casing 108 and the support 104 of the second vanes 94.

The shrouds 112 for the second blades 50 are then assembled to the aft casing 108 which is followed by assembling the second blades 50 in the second disc both from the casing aft end 126. The third vanes 96 are next assembled to the casing 108 by the supports 104 from the casing aft end 126. The second spacer 56 is positioned over the third disc 40 from the casing aft end 126 and between the second and third discs 38 and 40 and against the second blade dovetails 50*b*. the third blades 52 are next assembled in the third disc 40 from the casing aft end 126 and the shrouds 112 surrounding the third blades 52 are assembled to the aft casing 108 also from the casing aft end 126.

The cone 62 is next positioned adjacent to the flange 34*a* of the third disc 40 and the third spacer 82 is positioned against the third dovetail 52*b* with its flange being positioned against the cone 62. The fourth vanes 98 are next assembled to the aft casing 108 from the casing aft end 126 for completing the assembly of the forward spool 34.

The fourth blades 76 are assembled in the fourth disc 64 of the aft rotor spool 60 remote from the aft casing 108 and then the aft rotor spool 60 is positioned in the aft casing 108 from the casing aft end 126 adjacent to the third disc 40. The flange 60*a* extending from the fourth disc 64 is conventionally fixedly joined to the flange 34*a*, the cone 62, and the third spacer 82, for example by bolts (not shown) for joining together the third and fourth discs 40 and 64.

The shrouds 112 surrounding the fourth blades 76 are next assembled to the aft casing 108 from the casing aft end 126, and then the fifth vanes 100 are assembled from the casing aft end 126 to the aft casing 108 with the respective supports 104 conventionally joined to the fourth stage shrouds 112 and the aft casing 108.

The fourth spacer 84 is next positioned over both the sixth and fifth discs 68 and 66, between the fourth and fifth discs 64 and 66 and against the fourth dovetails 76*b*. The fifth blades 78 are next assembled in the fifth disc 66 from the casing aft end 126 and the fifth stage shrouds 112 are assembled to the aft casing 108. The sixth vanes 102 are next assembled to the aft casing 108 from the casing aft end 126 with the supports 104 joining the fifth stage shrouds 112 and the aft casing 108.

The fifth spacer 86 is next positioned over the sixth disc 68 from the casing aft end 126, between the fifth and sixth discs 66 and 68 and against the fifth blade dovetails 78*b*. The sixth blades 80 are next assembled in the sixth disc 68 from the casing aft end 126, with the sixth stage shrouds 112 being next assembled to the aft casing 108. Finally, the aft retainer 90 is assembled to the sixth disc 68 for locking axially together all of the blades 48, 50, 52, 76, 78, and 80 between the forward and aft retainers 88 and 90, and the first, second, third, fourth, and fifth spacers 54, 56, 82, 84, and 86.

The assembly including the forward rotor spool 34, the cone 62, and the aft rotor spool 60 is then conventionally balanced. Since basically only three pieces are being balanced instead of, for example, seven conventional pieces (i.e., six discrete rotor discs bolted together to a seventh cone member) improved rotor balance may be obtained which reduces the amount of required correction as well as eliminates conventional bolted joints between respective discs which could lead to unbalance and engine vibration.

The forward rotor spool 34, cone 62, aft rotor spool 60, and the aft casing 108 assembly may then be assembled as a module to the remainder of the engine 10 at the flange 110.

Accordingly, the improved turbine assembly disclosed herein utilizes a unitary annular aft casing 108 without horizontal split flanges and the attendant thermal and pressure distortions thereof. Conventional bolted rotor disc assemblies are eliminated which thusly reduces weight. The three piece forward and aft rotor spools and cone improves overall balance of the assembly and reduces engine vibration. The turbine assembly is also a modular construction which may be simply bolted to the forward casing 106 at the flange 110. And, manufacturing costs are reduced since only three dovetail broach sets are required to cut the six sets of dovetail slots in the six rotor discs.

Of particular significance in the present invention, are the spacers 54, 56, 82, 84, and 86. The spacers are unitary annular members which, except for the third spacer 82, are simply installable over respective ones of the rotor discs. The spacers provide effective axial retention of the respective blades between adjacent rotor discs. The spacers also include the integral labyrinth teeth 120 for forming seals with the respective stator vanes. And, the opposite axial ends of the spacers which abut the respective blade dovetails are also effective for providing seals between the spacer ends and respective discs, as shown for example at the aft end of the first spacer 54 illustrated in FIG. 4.

While there has been described herein what is considered to be a preferred embodiment of the present invention, other modifications of the invention shall be apparent to those skilled in the art from the teachings herein, and it is, therefore, desired to be secured in the appended claims all such modifications as fall within the true spirit and scope of the invention.

For example, although cylindrical spacers are shown, other types of annular spacers may also be used, such as conical or stepped, as long as the inner diameters thereof allow them to be assembled over the respective discs as described above. Also, the forward and aft rotor spools may be joined together by alternate means, and single rotor spool may be used alone.

Furthermore, although the dovetail slots (a) and dovetails (b) are shown as being aligned axially and radially inclined relative to the engine axial centerline axis 12, they may alternatively be conventionally skewed in the circumferential direction at an acute skew angle relative to the centerline axis 12 in accordance with the present invention. For example, the first broach line $B_1$ may be inclined both radially at the first broach angle $A_1$ and circumferentially at the skew angle so that both the dovetail slots (a) and dovetails (b) are skewed for accommodating conventional high twist blades.

Accordingly, what is desired to be secured by Letters Patent of the United States is the invention as defined and differentiated in the following claims:

I claim:

1. A turbine assembly comprising:

a unitary first rotor spool including first and second axially spaced rotor discs having first and second perimeters, first and second outer diameters, and pluralities of circumferentially spaced axially extending first and second dovetail slots, respectively;

a plurality of first blades having first dovetails disposed in said first slots;

a plurality of second blades having second dovetails disposed in said second slots; and a unitary annular first spacer disposed axially between said first and second dovetails for preventing said first and second blades from sliding axially toward said first spacer, said first spacer having a first inner diameter greater than said first outer diameter of said first rotor disc for allowing said first spacer to be assembled over said first disc.

2. A turbine assembly according to claim 1 further including a plurality of circumferentially spaced rabbets extending axially from at least one of said first and second rotor discs for radially supporting said first spacer.

3. A turbine assembly according to claim 1 further including:

a unitary annular casing surrounding said first and second blades; and a plurality of removable, circumferentially spaced stator vanes extending radially inwardly from said casing and axially between said first and second blades.

4. A turbine assembly according to claim 3 wherein said first spacer includes a plurality of radially outwardly extending labyrinth seal teeth for forming a seal with said stator vanes.

5. A turbine assembly according to claim 1 further including an equal number of said first and second dovetail slots with respective ones thereof being axially aligned with each other.

6. A turbine assembly according to claim 5 wherein said respective first and second dovetail slots are axially aligned along a first broach line, and said first broach line is inclined at an acute first broach angle relative to a longitudinal centerline axis of said first rotor spool so that said second outer diameter of said second rotor disc is larger than said first outer diameter.

7. A turbine assembly according to claim 1 further comprising:

said first rotor spool including a third rotor disc spaced axially from said second rotor disc, said third rotor disc having a third perimeter, a third outer diameter, and a plurality of circumferentially spaced axially extending third dovetail slots;

a plurality of third blades having third dovetails disposed in said third slots; and a unitary annular second spacer disposed axially between said second and third dovetails, said second spacer having a second inner diameter greater than at least one of said second outer diameter and said third outer diameter for allowing said second spacer to be assembled over respective ones of said second and third discs.

8. A turbine assembly according to claim 7 further including:

an equal number of said first and second dovetail slots with respective ones thereof being axially aligned with each other along a first broach line, said first broach line being inclined at an acute first broach angle relative to a longitudinal centerline axis of said first rotor spool so that said second outer diameter is larger than said first outer diameter;

each of said third dovetails lots being axially aligned along a second broach line inclined at an acute second broach angle relative to said centerline axis; and said first and second broach angles being selected so that said first broach line extends over said third perimeter, and said second broach line extends over both said first and second perimeters.

9. A turbine assembly according to claim 7 further including:

a unitary annular casing surrounding said first, second and third blades;

a plurality of removable, circumferentially spaced second stator vanes extending radially inwardly from said casing and axially between said first and second blades; and a plurality of removable, circumferentially spaced third stator vanes extending radially inwardly from said casing and axially between said second and third blades.

10. A turbine assembly according to claim 9 wherein each of said first and second spacers includes a plurality of radially outwardly extending labyrinth seal teeth for forming a seal with respective ones of said second and third stator vanes.

11. A turbine assembly according to claim 10 wherein said second inner diameter is greater than said third outer diameter.

12. A turbine assembly according to claim 10 wherein said second inner diameter is greater than said second outer diameter.

13. A turbine assembly according to claim 12 further comprising:

a unitary second rotor spool including fourth, fifth, and sixth axially spaced rotor discs having fourth, fifth, and sixth perimeters, said fourth disc being disposed downstream of said third disc, and further including forth, fifth, and sixth outer diameters and pluralities of circumferentially spaced axially extending fourth, fifth, and sixth dovetail slots, respectively;

pluralities of fourth, fifth, and sixth blades having fourth, fifth, and sixth dovetails disposed in said fourth, fifth, and sixth dovetail slots, respectively;

a unitary annular third spacer disposed axially between said third and fourth dovetails for preventing said third and fourth blades from sliding axially toward said third spacer;

a unitary annular fourth spacer disposed axially between said fourth and fifth dovetails for preventing said fourth and fifth blades from sliding axially toward said fourth spacer; and a unitary annular fifth spacer disposed axially between said fifth and sixth dovetails for preventing said fifth and sixth blades from sliding axially toward said fifth spacer.

14. A turbine assembly according to claim 13 further including:

an equal number of said fifth and sixth dovetail slots with respective ones thereof being axially aligned along a third broach line inclined at an acute third broach angle relative to said centerline axis so that said fifth outer diameter is larger than said sixth outer diameter;

said fourth dovetail slots being axially aligned along a fourth broach line inclined at an acute fourth broach angle relative to said centerline axis; and said third and fourth broach angles being selected so that said third broach line extends over said fourth perimeter, and said fourth broach line extends over both said fifth and sixth perimeters.

15. A turbine assembly according to claim 14 further comprising:

said casing extending axially over said fourth, fifth, and sixth blades;

a plurality of removable, circumferentially spaced forth stator vanes extending radially inwardly from said casing and axially between said third and fourth blades;

a plurality of removable, circumferentially spaced fifth stator vanes extending radially inwardly from said casing and axially between said fourth and fifth blades; and a plurality of removable, circumferentially spaced sixth stator vanes extending radially inwardly from said casing and axially between said fifth and sixth blades.

16. A turbine assembly according to claim 15 wherein said third, fourth, and fifth spacers include radially outwardly extending labyrinth seal teeth for forming seals with said third, fourth, and fifth stator vanes, respectively.

17. A turbine assembly according to claim 16 wherein said third and fourth discs are removably fixedly joined to each other.

18. A turbine assembly according to claim 17 wherein said third spacer is removably fixedly joined to said third and fourth discs.

19. A turbine assembly according to claim 18 wherein said first broach angle is equal to said third broach angle, and said second broach angle is equal to said fourth broach angle.

20. A method of assembling said turbine assembly of claim 19 comprising:

positioning said first rotor spool inside said casing;

assembling said second vanes to said casing from an aft end of said casing;

positioning said first spacer from a forward end of said casing over said first disc and between said first and second discs;

assembling said first blades in said first disc from said casing forward end;

assembling a forward retainer ring to said first disc;

assembling said second blades in said second disc from said casing aft end;

assembling said third vanes to said casing from said casing aft end;

positioning said second spacer from said casing aft end over said third disc, between said second and third discs and against said second blade dovetails;

assembling said third blades in said third disc from said casing aft end;

positioning said third spacer against said third blade dovetails;

assembling said fourth vanes to said casing from said casing aft end;

assembling said fourth blades in said fourth disc on said second rotor spool;

positioning said second rotor spool in said casing adjacent to said third disc;

joining together said third and fourth discs;

assembling said fifth vanes to said casing from said casing aft end;

positioning said fourth spacer over both said fifth and sixth discs, between said fourth and fifth discs and against said fourth blade dovetails;

assembling said fifth blades in said fifth disc from said casing aft end;

assembling said sixth vanes to said casing from said casing aft end;

positioning said fifth spacer over said sixth disc from said casing aft end, between said fifth and sixth discs and against said fifth blade dovetails; and assembling said sixth blades in said sixth disc from said casing aft end.

* * * * *